US009493904B2

(12) United States Patent
Koch et al.

(10) Patent No.: US 9,493,904 B2
(45) Date of Patent: Nov. 15, 2016

(54) LAUNDRY TREATMENT DEVICE HAVING A STEAM GENERATOR AND METHOD FOR TREATING ITEMS TO BE WASHED

(75) Inventors: Thomas Koch, Berlin (DE); Ingo Schulze, Penketal (DE)

(73) Assignee: BSH Hausgeräte GmbH, Munich (DE)

( * ) Notice: Subject to any disclaimer, the term of this patent is extended or adjusted under 35 U.S.C. 154(b) by 1113 days.

(21) Appl. No.: 13/318,814

(22) PCT Filed: Apr. 22, 2010

(86) PCT No.: PCT/EP2010/055343

§ 371 (c)(1),
(2), (4) Date: Nov. 4, 2011

(87) PCT Pub. No.: WO2010/145869

PCT Pub. Date: Dec. 23, 2010

(65) Prior Publication Data

US 2012/0047662 A1 Mar. 1, 2012

(30) Foreign Application Priority Data

May 5, 2009 (DE) ..... 10 2009 002 814

(51) Int. Cl.

| | |
|---|---|
| ***D06F 58/20*** | (2006.01) |
| ***D06F 39/00*** | (2006.01) |
| ***D06F 39/04*** | (2006.01) |
| ***D06F 58/28*** | (2006.01) |

(52) U.S. Cl.

CPC ..... *D06F 58/203* (2013.01); *D06F 39/008* (2013.01); *D06F 39/04* (2013.01); *D06F 58/28* (2013.01)

(58) Field of Classification Search

None

See application file for complete search history.

(56) References Cited

U.S. PATENT DOCUMENTS

| | | | | |
|---|---|---|---|---|
| 1,642,092 | A | 9/1927 | Smith | |
| 2007/0006484 | A1 | 1/2007 | Moschuetz et al. | |
| 2009/0320317 | A1* | 12/2009 | Bae et al. | 34/282 |

FOREIGN PATENT DOCUMENTS

| | | | | |
|---|---|---|---|---|
| CN | 2514022 | | 10/2002 | |
| DE | 3408136 | A * | 9/1985 | D06F 58/20 |
| DE | 3408136 | A1 | 9/1985 | |

(Continued)

OTHER PUBLICATIONS

English machine translation of DE3408136A.*

(Continued)

*Primary Examiner* — Michael Barr
*Assistant Examiner* — Jason Riggleman
(74) *Attorney, Agent, or Firm* — Nixon & Vanderhye P.C.

(57) ABSTRACT

A laundry treatment device includes a treatment chamber for receiving items to be washed and a steam generator supplied with water from a water source by a pump. A first line connects the steam generator to the treatment chamber, and an inlet is provided for introducing steam into the treatment chamber. Arranged between the steam generator and the treatment chamber is a nebulizer facility arranged which is connected by way of a switching valve via second lines to the treatment chamber. The nebulizer facility is constructed to mix treatment agents in the form of an aerosol with the steam.

14 Claims, 1 Drawing Sheet

(56) References Cited

FOREIGN PATENT DOCUMENTS

| | | | |
|---|---|---|---|
| EP | 1275767 | A1 | 1/2003 |
| EP | 1441058 | A1 | 7/2004 |
| EP | 1441060 | A1 | 7/2004 |
| WO | 2007036470 | A1 | 4/2007 |

OTHER PUBLICATIONS

English Translation of Office Action issued in corresponding Chinese Appln. No. 2010800175152, issued May 28, 2013, 4 pages.
International Search Report PCT/EP2010/055343.
Report of Examination DE 10 2009 002 814.5.

* cited by examiner

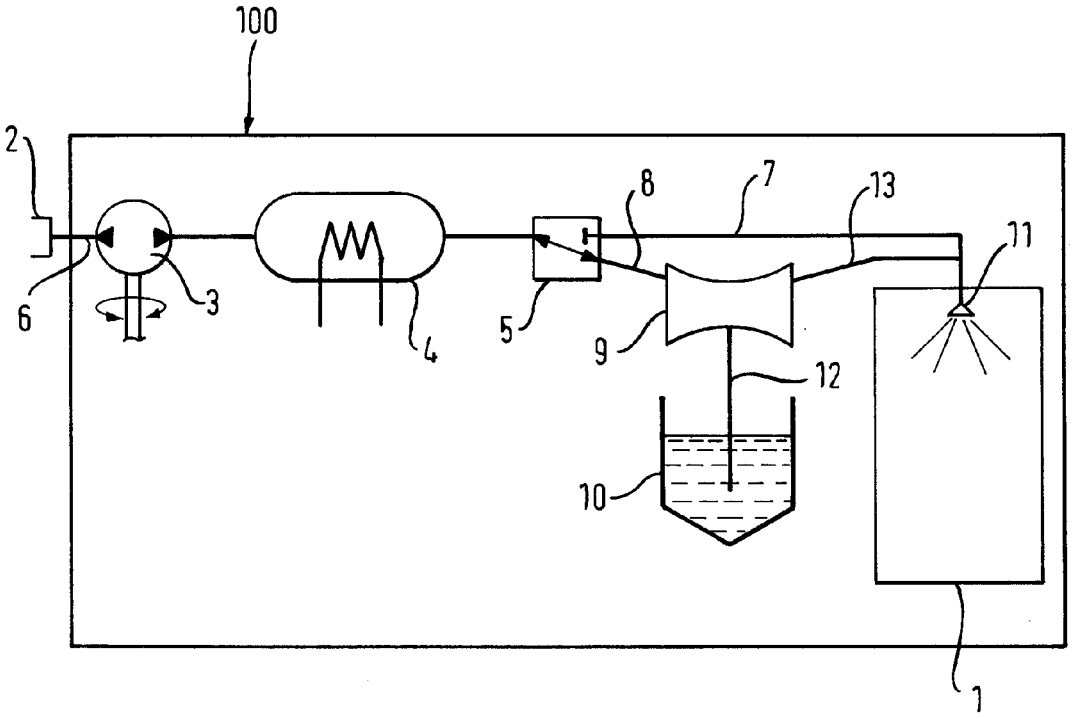
100
2
6
3
4
5
8
7
13
11
9
12
10
1

LAUNDRY TREATMENT DEVICE HAVING A STEAM GENERATOR AND METHOD FOR TREATING ITEMS TO BE WASHED

BACKGROUND OF THE INVENTION

The invention relates to a laundry treatment appliance comprising a treatment chamber for receiving laundry items, a steam generator that can be supplied with water by a pump by way of a water source, a line that connects the steam generator to the treatment chamber and an inlet for introducing steam into the treatment chamber. The invention also relates to a method for treating laundry items in such a laundry treatment appliance.

It is known in household laundry treatment appliances, particularly tumble dryers but also washing machines and washer-dryers, to offer various additional functions. These include for example the smoothing of textiles, the reduction of creasing, odor elimination, e.g. by way of stream extraction, heating with steam in addition or as an alternative to conventional heating and even hygiene measures for both laundry care and appliance care.

EP 1 275 767 A1 therefore discloses a tumble dryer or automatic washing machine having a steaming apparatus, with which after water has been extracted, steam is supplied to the laundry by heating the water at the bottom of the tub until steam is produced. The steam penetrates into the drum and acts on the laundry therein.

DE 102 60 151 A1 describes a laundry treatment appliance, with which a processing unit for a fluid to generate mist or vapor is connected to the process air channel, so that vapor can be introduced into the laundry drum by way of the process air supply. This is to eliminate odorous substances from textiles. A similar method is also described in DE 10 2005 046 163 A1.

DE 103 02 866 A1 describes a tumble dryer having a laundry drum and a spray facility disposed on an air outlet and/or a loading opening of the laundry drum to spray at least one additional substance into the laundry drum, as well as a control facility to control the drying process. The control facility can be used here as the at least one additional substance is being sprayed in to reduce the transport power of the fan, to stop the air flow or reverse the transport direction. Steam can be generated by heating water to provide the additional substance, which can then be used to disinfect the laundry or to activate a further additional substance.

DE 34 08 136 A1 describes a method for treating textile items such as fibers, textiles, skins, pelts and the like, wherein the items are treated with a fluid mist and dried by a warm air supply, the fluid mist being formed by atomizing the fluid by means of a gas jet. The gas jet used can be a steam jet. According to one embodiment the fluid is sucked directly out of a container by way of a suction nozzle on the atomizer facility, the atomizer facility advantageously being configured as a gas jet/fluid pump.

BRIEF SUMMARY OF THE INVENTION

The object of the invention was therefore in particular to provide an improved laundry treatment appliance having a steam generator.

According to the invention this object is achieved by an apparatus and method having the features of the respective independent claims. The dependent claims relate to preferred embodiments which can be used individually or in combination with one another. Preferred embodiments of the method here correspond to preferred embodiments of the apparatus and vice versa, within the context of the technically expedient, even if specific reference is not made thereto. Preferred embodiments are also set out in the description which follows.

The invention relates in particular to a laundry treatment appliance, comprising a treatment chamber to receive laundry items, a steam generator, that can be supplied with water by a pump by way of a water source, a line that connects the steam generator to the treatment chamber and an inlet for introducing steam into the treatment chamber. Between the steam generator and the treatment chamber a nebulizer facility is additionally connected by way of a switching valve via lines to the treatment chamber, the nebulizer facility being able to mix treatment agents in the form of an aerosol with the steam.

The present invention further relates to a method for treating laundry items in a laundry treatment appliance, said method comprising the following steps:

- providing laundry items in the laundry treatment appliance,
- generating steam,
- generating a treatment agent aerosol,
- generating a mixture of the treatment agent aerosol and the generated steam,
- treating the laundry items with the mixture.

This method is preferably performed in the inventive laundry treatment appliance.

The invention has the advantage that, in contrast to the methods and appliances from the prior art, steam is not only used as the treatment agent but rather as a carrier medium for other mediums that cannot generally be applied by way of steam, for example in household textile care. The steam generated preferably consists 100% of water and should be able to condense in the presence of condensation cores. It is generally therefore what is known as saturated steam, which is preferably heated. The temperature of the steam can be selected depending on the application and treatment agent and the associated steam generator can be selected or set accordingly.

The steam generator is preferably disposed outside the treatment chamber and connected by way of a line to the interior of the treatment chamber. In the simplest instance the steam generator can be an apparatus for generating hot water or a closed heated vessel or a pressurized pipe system.

Like the steam generator, the nebulizer for the treatment agent is also preferably outside the treatment chamber, so that steam and treatment agent aerosol can be mixed first and introduced as a mixture into the treatment chamber. All known nebulizer facilities for fluids or solid substances are suitable nebulizer facilities. They can be spray nebulizers, pressure nebulizers, ultrasonic nebulizers and even a venturi nozzle. The nebulizer is also connected by way of a line to the interior of the treatment chamber, preferably so that the line carrying the steam also meets the line carrying the treatment agent aerosol outside the treatment chamber, so that both combine to form a mixture. When this mixture is introduced into the treatment chamber, the aerosol particles in the steam serve as condensation cores and small homogeneous water droplets consisting of water and the nebulized treatment agent form in the flow of steam.

It is also possible to couple the steam generator and the nebulizer facility to one another so that the steam promotes nebulization. This can take place for example by way of a venturi nozzle operated by the steam. The steam flow here is conducted at high speed past the suction region of the nozzle. The treatment agent to be nebulized is sucked out of a storage container in this process, atomized finely and carried along in the steam.

Almost all fluid substances from the areas of textile cleaning, textile care, health, wellness, cosmetics and other areas can be applied as treatment agents to the items to be treated in the laundry treatment appliance. Solid substances can also be nebulized or atomized to form aerosols, being distributed as a fine powder in the steam for example.

In one specific embodiment of the invention the speed of the steam flow and therefore the quantity of substance to be nebulized can be regulated. In the simplest instance this can be done by switching the steam outlet paths. However it can also be done by regulating the water supply to the steam generator or by regulating the evaporator output.

The treatment chamber of the laundry treatment appliance, if this is a washing machine, is the tub and if it is a standard tumble dryer, it is the drum. It is advantageous to select the inward air flow for the steam and the treatment agent aerosol so that the mixture is distributed as evenly as possible in the treatment chamber. This inlet can advantageously be located in the region of the drum rear wall, or in the region between the dryer heater and the drum rear wall. However steam generation and the nebulization of the medium in the steam flow can also take place directly in the region between the dryer heater and the drum rear wall.

It is particularly preferable for the inlet to be located directly on the treatment chamber configured as a laundry drum, in particular in the region of a seal or, in the case of a washing machine or washer-dryer also in the region between the tub and the laundry drum.

In one particular embodiment the inlet for the mixture can also be selected to that it is conducted by the wash liquor present in the tub or by the fresh water supply. This has the advantage that a treatment agent can also be supplied in this manner by way of steam to the laundry items to be treated during the wash process.

The treatment agent is advantageously provided in a storage container for single or multiple use, it being possible for said container to be configured as a replaceable cartridge or a refillable container.

One advantage of the invention lies in the use of steam as a carrier medium for nebulized or atomized substances, which otherwise would be difficult to distribute evenly in laundry items to be treated. Because steam mixed with a treatment agent aerosol is conducted by the washing water, even small concentrations of treatment agent can be distributed evenly in the washing water and can even be applied after washing. This circumvents in particular the disadvantage that fragrances and the like in the washing agent are largely washed out of the items being treated again during washing or rinsing or evaporate quickly due to low boiling temperatures during treatment in the tumble dryer, with the result that they do not impart a lasting fragrance to the items being treated.

The items to be treated are generally items to be washed or dried, which are treated in a household laundry treatment appliance, i.e. generally laundry of all types of textiles and fabrics. Laundry treatment appliances, for which the present invention is suitable, are in particular washing machine, dryers and washer-dryers.

BRIEF DESCRIPTION OF THE DRAWINGS

The invention is now described in more detail based on preferred exemplary embodiments and with reference to the drawing, in which:

FIG. 1 shows a schematic diagram of the structure of a laundry treatment appliance.

DETAILED DESCRIPTION OF EXEMPLARY EMBODIMENTS OF THE PRESENT INVENTION

FIG. 1 shows the treatment chamber 1 of a laundry treatment appliance 100, which is connected to a water source 2. The treatment chamber 1 here is a rotatable laundry drum 1, which receives the items to be treated, in particular items to be washed or dried. A line 6 conducts water through a pump 3 into a steam generator 4. Steam is generated here, which can be conducted under pressure by way of a switching valve 5 and through a line 6 through the inlet 11 into the treatment container 1. This inlet 11 is disposed directly on the treatment container 1; in the case of a washing machine the inlet 11 could be disposed in a seal, which seals a gap between a closed door and the treatment chamber 1, so that the steam can pass from the inlet 11 directly into the laundry drum 1. Also shown is a nebulizer facility 9, in this instance in the form of a venturi nozzle 9, which is supplied with the steam by way of the line 8 and the switching valve 5. On the suction side of the venturi nozzle 9 is a line 12, which sucks treatment agent out of a storage container 10. The nebulized treatment agent is supplied by way of the line 13 and by way of the inlet 11 to the treatment container. The switching valve 5 allows just steam to be introduced by way of the line 7 into the treatment container, or steam mixed with the treatment agent aerosol by means of the venturi nozzle 9 by way of the line 13. This embodiment is particularly advantageous, since it permits both the advantages of conventional steam treatment and also the additional application of further treatment agents in the form of aerosols, formed in particular by means of the venturi principle.

The invention claimed is:

1. A laundry treatment appliance configured to selectively apply nebulized treatment agents to items placed within the appliance, the appliance comprising:

a treatment chamber configured to receive laundry items, the treatment chamber having an inlet;

a water pump;

a steam generator configured to be supplied with water from a water source by the water pump;

a switching valve configured to move between first and second positions;

a nebulizer facility arranged between the steam generator and the treatment chamber; and a storage container configured to store laundry treatment agents, the storage container being configured to be in fluid communication with the nebulizer facility;

wherein:

the switching valve is configured to direct steam along a first line when in the first position whereby steam passes through the nebulizer facility on its way to the inlet of the treatment chamber, and to direct steam along a second line when in the second position whereby steam does not pass through the nebulizer facility on its way to the inlet of the treatment chamber;

when the switching valve is in the first position, the nebulizer facility is configured to mix treatment agents from the storage container with a steam supply generated by the steam generator and produce an aerosol prior to entry to the inlet of the treatment chamber.

2. The laundry treatment appliance of claim 1, wherein the nebulizer facility is a venturi nozzle.

3. The laundry treatment appliance of claim 1, wherein the inlet is disposed directly on the treatment chamber which is configured as a laundry drum.

4. The laundry treatment appliance of claim 1, wherein the appliance further comprises a mixing zone between the switching device and the treatment chamber and a second line connecting the nebulizer facility to the mixing zone, whereby the mixing zone is configured to mix the steam carried by the first line and the aerosol into a mixture prior to the mixture entering the treatment chamber.

5. The laundry treatment appliance of claim 1, wherein the storage container is a removable and/or refillable container.

6. The laundry treatment appliance of claim 1, wherein the laundry treatment agents are solids embodied as powders.

7. The laundry treatment appliance of claim 1, wherein the first line extends from the switching valve to the nebulizer facility, and a third line is connected downstream of the nebulizer facility and configured to deliver steam to the inlet of the treatment chamber.

8. A method for treating laundry items in a laundry treatment appliance, comprising:

providing laundry items in a treatment chamber of the laundry treatment appliance;

generating steam;

generating a treatment agent aerosol using a nebulizer;

operating a switching valve to move between a first position corresponding to a first steam line and a second position corresponding to a second steam line;

if the valve is moved to the first position, directing the steam via the first steam line directly to the treatment chamber; and if the valve is moved to the second position:

directing the steam along the second steam line for combination with the treatment agent aerosol, creating a mixture of the treatment agent aerosol and the generated steam.

9. The method of claim 8, further comprising utilizing steam to generate the treatment agent aerosol using the nebulizer.

10. The method of claim 8, further comprising storing a laundry treatment agent in a storage container which is configured to supply the laundry treatment agent to the nebulizer.

11. The method of claim 10, wherein the storage container is removable.

12. The method of claim 10, wherein the storage container is refillable.

13. The method of claim 8, further comprising providing laundry treatment agents in a solid form for use by the nebulizer in generating the aerosol.

14. The method of claim 8, wherein the nebulizer is venturi nozzle.

* * * * *